US005228943A

United States Patent [19]

Vasilakes

[11] Patent Number: 5,228,943

[45] Date of Patent: Jul. 20, 1993

[54] LOW IMPACT TAPE APPLYING DEVICE

[75] Inventor: Lloyd S. Vasilakes, North St. Paul, Minn.

[73] Assignee: Minnesota Mining and Manufacturing Company, St. Paul, Minn.

[21] Appl. No.: 532,589

[22] Filed: Jun. 4, 1990

[51] Int. Cl.[5] ..... B32B 31/00

[52] U.S. Cl. ..... 156/468; 156/475; 156/355; 156/486; 156/522

[58] Field of Search ..... 156/465, 468, 522, 355, 156/200, 201, 475, 477.1, 478, 482, 486

[56] References Cited

U.S. PATENT DOCUMENTS

| | | | |
|---|---|---|---|
| 2,052,903 | 9/1936 | Stagmeier | 216/23 |
| 2,107,900 | 2/1938 | Munro | 216/33 |
| 2,646,837 | 7/1953 | Brandenburg et al. | 154/1.6 |
| 2,649,221 | 8/1953 | Wagner et al. | 216/22 |
| 2,653,727 | 9/1953 | Wagner et al. | 216/22 |
| 2,684,240 | 7/1954 | Lindsey | 271/2.3 |
| 2,906,426 | 9/1959 | Fritzinger | 216/30 |
| 3,045,402 | 7/1962 | Keely | 53/66 |
| 3,052,072 | 9/1962 | Keely | 53/66 |
| 3,079,977 | 3/1963 | Larkin | 156/353 |
| 3,530,027 | 9/1970 | Nuckols | 156/582 |
| 3,535,189 | 10/1970 | Hall et al. | 156/486 |
| 3,540,969 | 11/1970 | Jorgensen | 156/523 |
| 3,560,308 | 2/1971 | Buck | 156/522 |
| 3,561,190 | 2/1971 | Derenthal | 53/67 |
| 3,915,786 | 10/1975 | Collett et al. | 156/482 X |
| 3,954,550 | 5/1976 | Patterson | 156/486 |
| 3,970,507 | 7/1976 | Dalzell | 156/446 |
| 3,988,193 | 10/1976 | Arens | 156/446 |
| 3,990,933 | 11/1976 | Verch | 156/250 |
| 4,028,865 | 6/1977 | Loveland et al. | 53/76 |
| 4,069,093 | 1/1978 | Linner | 156/522 |
| 4,120,741 | 10/1978 | Linner | 156/522 |
| 4,238,269 | 12/1980 | Deering, Jr. | 156/465 |
| 4,366,021 | 12/1982 | van der Wal | 156/468 |
| 4,370,787 | 2/1983 | Feldkamper | 29/124 |
| 4,541,888 | 9/1985 | Marchetti | 156/468 |
| 4,585,504 | 4/1986 | Marchetti | 156/351 |
| 4,592,189 | 6/1986 | Martini | 53/137 |
| 4,633,642 | 1/1987 | Lissoni | 53/137 |
| 4,642,157 | 2/1987 | Cavanaugh | 156/468 |
| 4,643,707 | 2/1987 | Marchetti | 493/117 |
| 4,653,247 | 3/1987 | Marchetti | 53/137 |
| 4,748,794 | 6/1988 | Marchetti | 53/137 |
| 4,789,418 | 12/1988 | Rayl | 156/475 X |
| 4,855,006 | 8/1989 | Marchetti | 156/486 X |
| 4,889,581 | 12/1989 | Ulrich et al. | 156/468 X |

FOREIGN PATENT DOCUMENTS

| | | |
|---|---|---|
| 1079624 | 6/1980 | Canada . |
| 0045262 | 2/1982 | European Pat. Off. . |
| 0251420 | 8/1985 | European Pat. Off. . |
| 181655A1 | 5/1986 | European Pat. Off. . |
| 3311170 | 6/1987 | Fed. Rep. of Germany . |
| 1384612 | 11/1964 | France . |
| 2440875 | 11/1978 | France . |
| 144865 | 6/1975 | Netherlands . |
| 424772 | 4/1978 | U.S.S.R. . |
| 1306828 | 4/1987 | U.S.S.R. . |
| 1585335 | 4/1978 | United Kingdom . |

*Primary Examiner*—David A. Simmons
*Assistant Examiner*—James J. Engel, Jr.
*Attorney, Agent, or Firm*—Gary L. Griswold; Walter N. Kirn; Mark W. Binder

[57] ABSTRACT

A device for applying tape to a box driven past the device in which the initial impact force of the device on the leading surface of the box is attenuated.

12 Claims, 10 Drawing Sheets

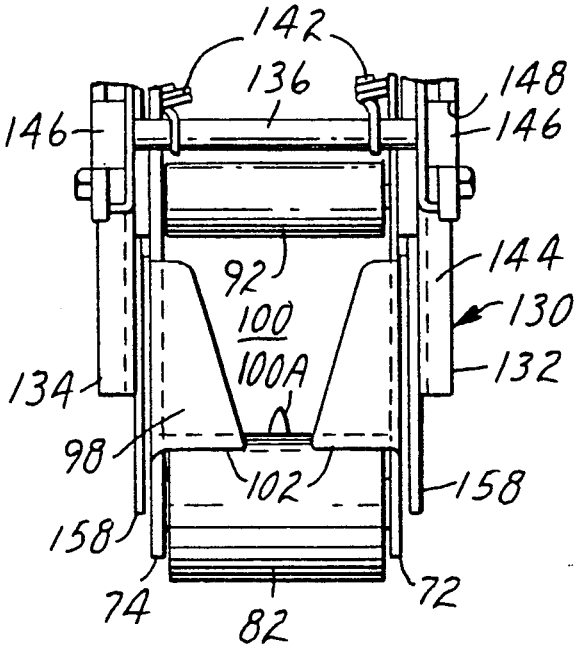
5A

LOW IMPACT TAPE APPLYING DEVICE

FIELD OF THE INVENTION

This invention relates to devices for applying lengths of pressure sensitive adhesive coated tape to rectangular objects such as a box driven along a predetermined path past the device.

BACKGROUND OF THE INVENTION

The art is replete with such devices for applying lengths of pressure sensitive adhesive tape, U.S. Pat. Nos. 3,915,786 and 3,954,550 being illustrative examples. Such devices are commonly used to seal rectangular boxes filled with merchandise driven past the device by a conveyer. Typically, such devices include an application member such as a roller for supporting an end of tape adhesive side out in a contact position at which tape end will be contacted by a box. Upon such contact, tape end adheres to the box. Further movement of the box then pulls tape from the device between the box and the application member which presses tape against the contour of the box. Subsequently, the applied length of tape is severed from the supply length of tape and means on the device engages tape adjacent the newly severed end and moves it with the application member back to its contact position for contact by the next box on the conveyer.

Typically, the application member is mounted at one end of an arm which has its other end pivotably mounted at one edge of the path for the boxes so that after the leading surface of the box contacts the tape on the member, the member will revolve about the pivot point of the arm to follow the contour of the box and press tape sequentially against the leading surface of the box, around a leading edge of the box defined by adjacent edge portions of two butted cover flaps of the box, and then over adjacent portions of the cover flaps longitudinally of the box to seal the cover flaps together. Because of the increase in angle between the leading surface of the box and a line between the pivot point for the arm and the application member as the box moves along the path, however, the force applied by the leading surface of the box to move the application member across its leading surface will increase significantly as the application member approaches the edge of the box and can become sufficiently large just before the edge of the box passes the application member to push in the leading wall of the box under its two cover flaps, particularly for lightly constructed boxes. This can jam the tape applying apparatus or damage merchandise in the box, and even if it does not, it will produce a taped box in which tape bridges several centimeters between the cover flaps of the box and a portion of the front surface of the box, which bridging is unsightly and potentially insecure. Further, folding back of the corners of flaps on the box may occur.

U.S. Pat. No. 4,238,269, entitled "Tape Applying Device" and issued to Deering, Jr., the contents of which are incorporated herein by reference, discloses one approach to overcome this problem in conventional tape applying devices having pivotally mounted application members. The application member in the '269 patent is mounted for movement along a generally linear path from a contact position at which it will be contacted by the leading surface of a box to a second position at which it will be against the one side of the box as the box moves past the application member Preferably, the linear path is disposed at an angle in the range of about 35 to 55 degrees (preferably 45 degrees) with respect to the path for the box so that one component of movement of the application member from its contact position to its second position is in the direction of movement of the box. With this arrangement the force applied to the leading surface of the box to move the application member to its second position is essentially uniform as the application member traverses the leading surface of the box and can be adjusted via means biasing the application member to its contact position so that firm engagement of tape against the entire front surface of the box will be provided.

This approach improved on prior designs in that the uniform force applied against the box attenuated damage to boxes as tape was applied. However, although the force exerted against the box was reduced (i.e. the force was kept relatively uniform and did not increase) as the application member approaches the leading edge of the box, it has been discovered that the initial force of impact of the application member against the leading surface of the box sometimes reached undesirably high levels, depending on the size and strength of the box, the contents of the box, the velocity of the box, and the inertia of tape applying device, among other factors. Thus, under some circumstances, the tape applying device of the '269 patent would damage a box or its contents upon the initial impact between the box and the tape applying device, or the speed of boxes moving past the device had to be reduced.

SUMMARY OF THE INVENTION

The present invention provides a device adapted for applying lengths of pressure sensitive adhesive coated tape from a supply length of tape seriatim on spaced rectangular objects driven along a predetermined path in a first direction past the device. The device includes: a frame; an application member having an arcuate periphery; means adapted for defining a tape route for a said supply length of tape to the arcuate periphery of said application member with the adhesive coating disposed away from said application member; means for mounting said application member on said frame to afford movement thereof from a contact position with said tape route in the path of the rectangular object to afford contact between an end of the tape disposed along said tape route and a leading surface of the rectangular object driven along the path in the first direction to adhere tape to the leading surface of the rectangular object, to a second position while pressing the tape against the leading surface of the rectangular object, at which second position said application member will press tape being applied against a longitudinal surface of the object, and back to said contact position, said mounting means including means for attenuating the impact force of the application member on the leading surface of the rectangular object; and means mounted on said frame and adapted to be activated by movement of the rectangular object past a predetermined position along the path for severing an applied length of tape from said supply length. Further, in one embodiment of the invention the device may include means for buffing the tape applied to the rectangular object.

DESCRIPTION OF THE DRAWING

The present invention will be further described with reference to the accompanying drawings wherein like numerals refer to like parts throughout the several views and wherein:

FIG. 5A is a partial front end view of an alternate embodiment of the upper tape applying device of FIG. 3.

DESCRIPTION OF THE PREFERRED EMBODIMENT

Figure 2:
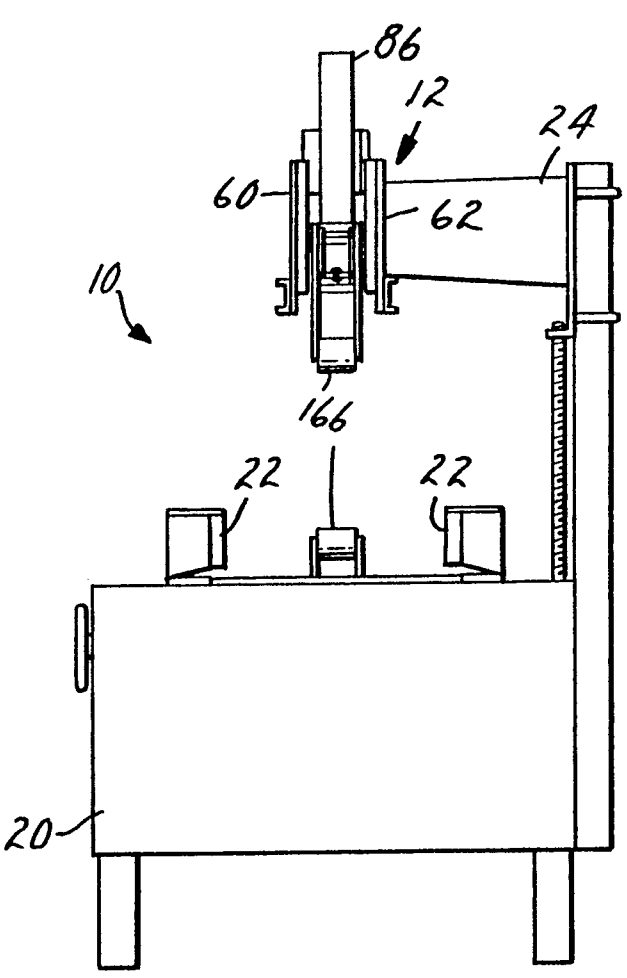
FIG. 2 is an end view of the machine shown in FIG. 1.

Referring now to the drawing, there is illustrated a machine 10 incorporating two tape-applying devices 12 and 14 according to the present invention disposed to apply lengths of pressure sensitive adhesive coated tape from supply lengths of tape 16 seriatim around the peripheries of spaced rectangular objects or boxes 18 driven along a predetermined path through machine 10.

Figure 1:
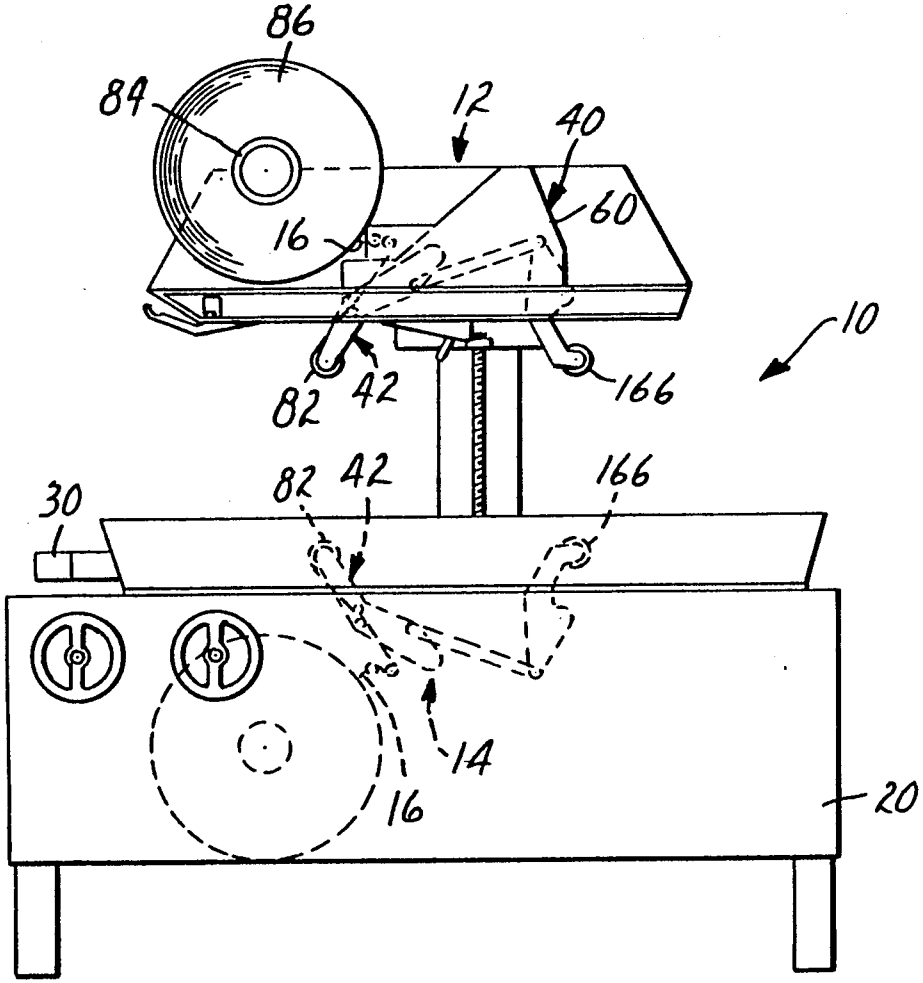
FIG. 1 is a side view of a machine incorporating two tape-applying devices according to the present invention.
Figure 3:
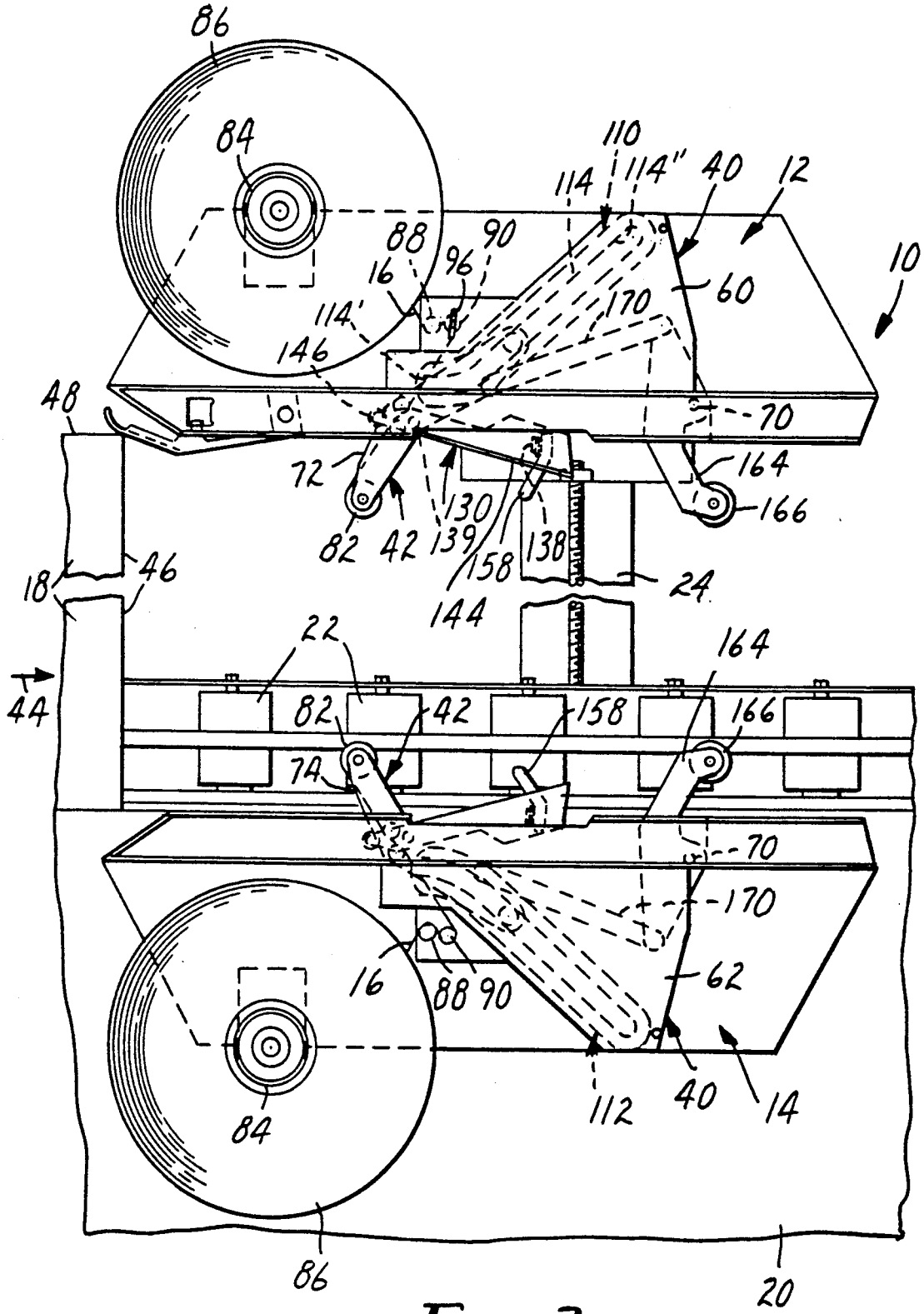
FIG. 3 is an enlarged fragmentary view of the two devices included in the machine showh in FIG. 1.
Figure 4:
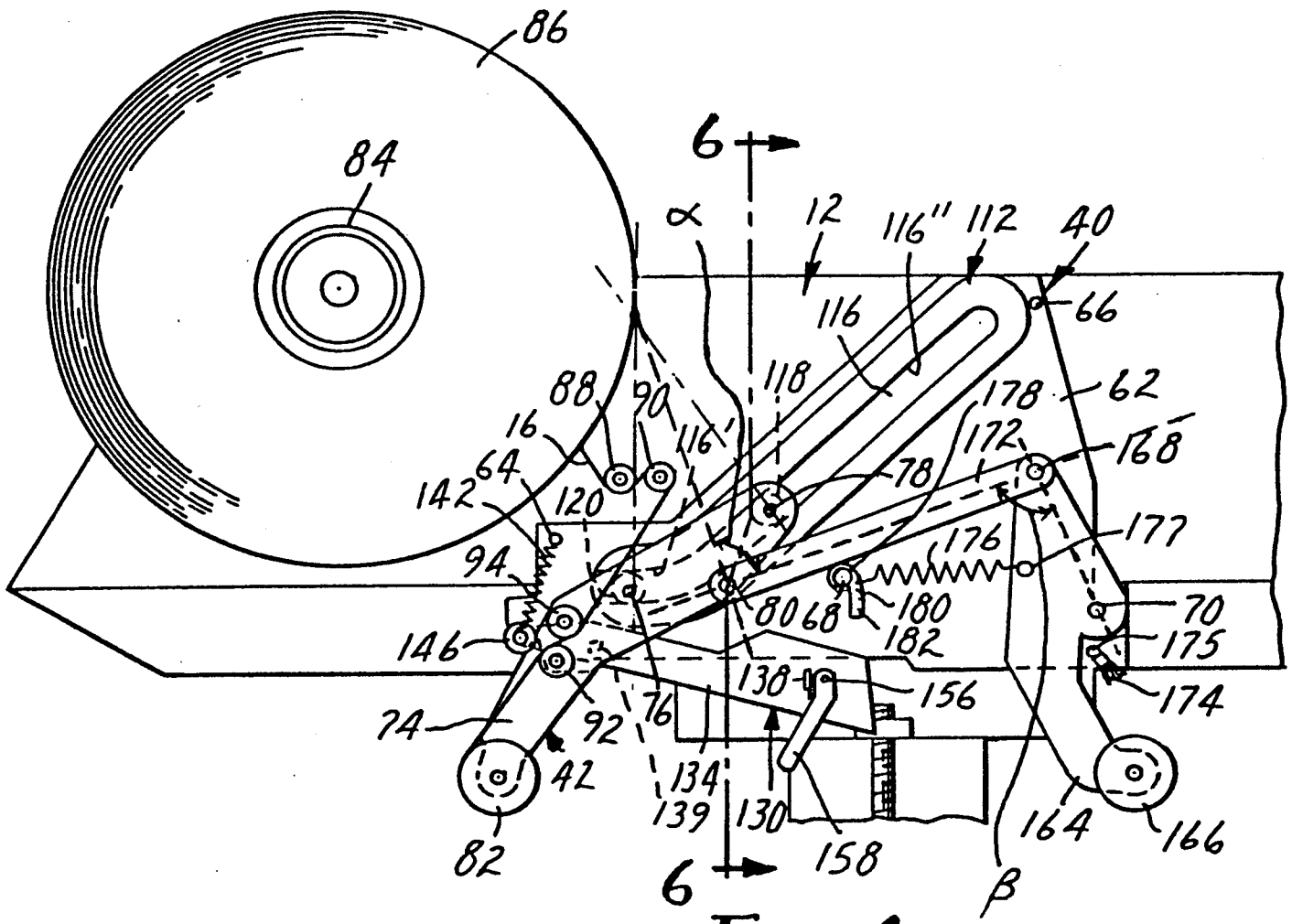
FIG. 4 is a longitudinal cross sectional view of the upper tape applying device of FIG. 3.
Figure 5:
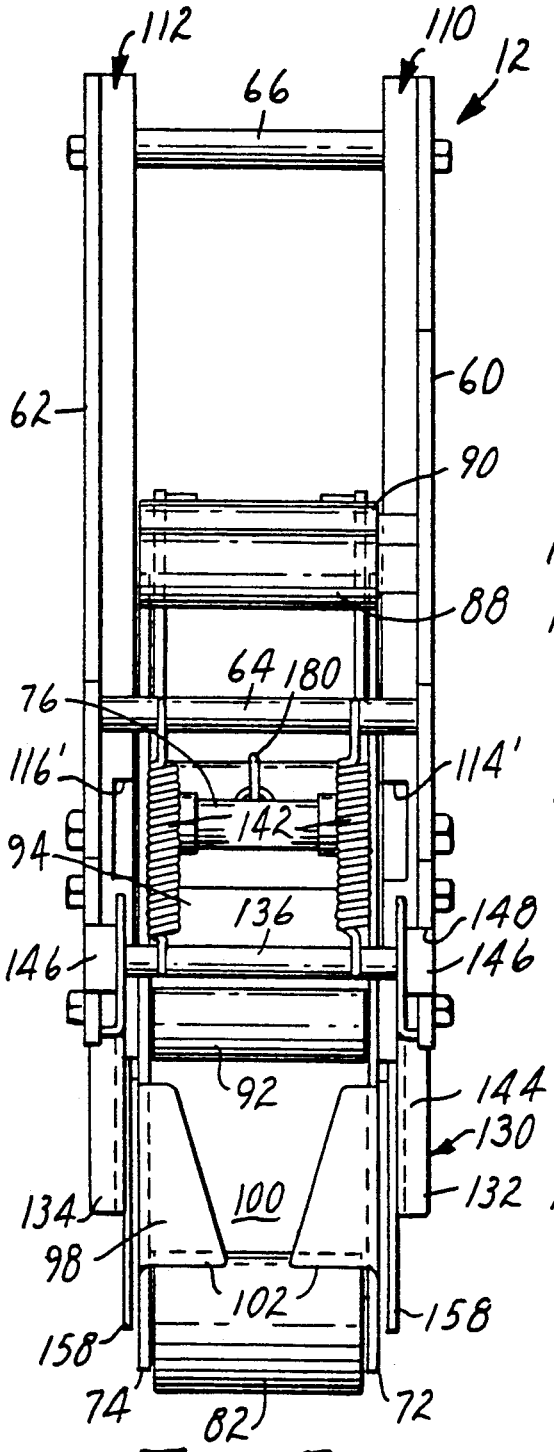
FIG. 5 is a front end view of the upper tape applying device of FIG. 3.
Figure 6:
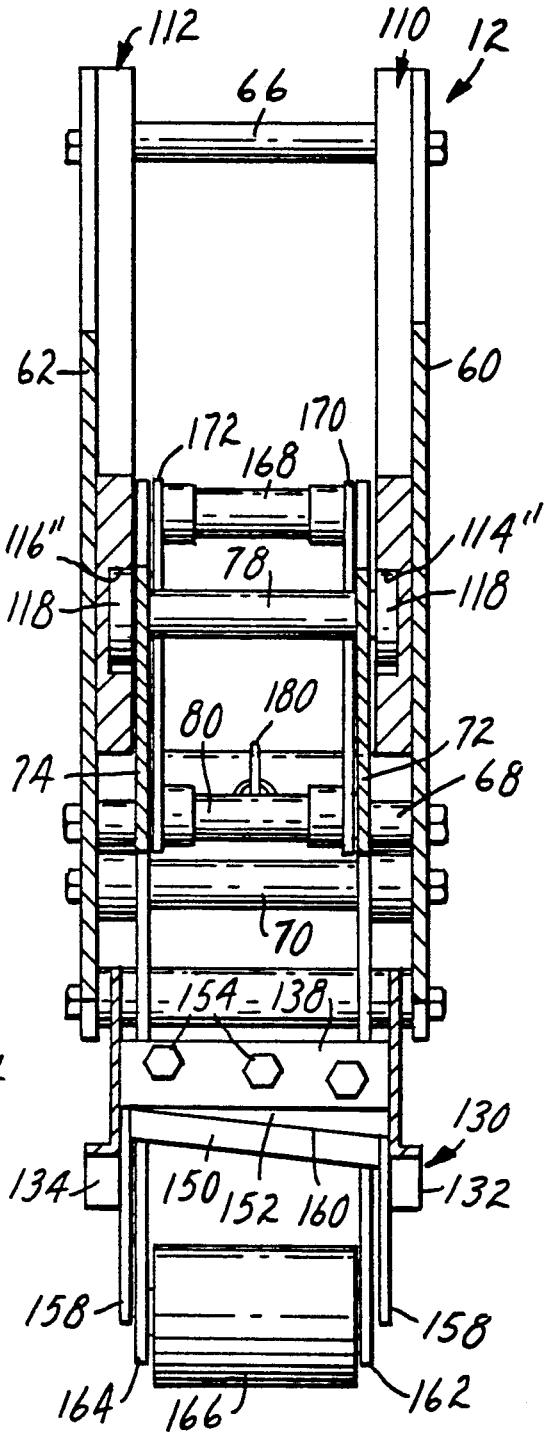
FIG. 6 is transverse cross sectional view along plane 6—6 of the tape applying device of FIG. 4.

As is seen in FIGS. 1 and 2, machine 10 comprises base portion 20 supporting tape-applying device 14 and including spaced conveyers 22 adapted to grip the sides of a box placed along the path and to propel the box past devices 12 and 14; and vertically movable upper frame portion 24 on which is supported the other tape applying device 12 and which is adapted to move vertically to bring uppermost tape applying device 12 into contact with the uppermost portions of a box propelled through machine 10. The machine 10 may be constructed so that the upper frame portion may be manually positioned at a desired height for boxes having the same dimensions, or the machine may include mechanisms activated when a box is encountered to automatically position the upper frame portion to the correct height for boxes having varying dimensions.

Machine 10 also includes means for moving conveyers 22 toward each other from an initial spaced apart position to positions at which they will engage the side surfaces of boxes of different widths to propel the boxes along the path. Machine 10 is also provided with means, such as machine activating lever 30, that activate operation of the machine and tape applying devices 12, 14, when a box passes through the machine. Such means are not described in detail herein since they are well known in the art.

Briefly, as is best seen in FIGS. 3 through 11, the device 12 includes frame 40; application member 42; means adapted for defining a tape route for a supply length of tape 16 to the application member with the adhesive coating disposed away from the application member; means for mounting the application member on the frame to afford movement thereof from a contact position (FIG. 8) with the tape in the predetermined path of a box moving in direction 44 to afford contact between the length of tape disposed along said tape route and the leading surface 46 of a box 18 driven along its predetermined path to adhere tape to the leading surface of the box, to a second position (FIGS. 8 and 9) while pressing tape against the leading surface of the box, at which second position said application member will press the tape being applied against longitudinal surface 48 of the box (FIG. 10), and back to said contact position (FIG. 11); means for attenuating the impact force of the application member on the leading surface of the rectangular object; and means mounted on the frame and adapted to be activated by movement of the box past a predetermined position along the predetermined path for severing an applied length of tape from the supply length. Further, the device may include means for buffing the tape against the longitudinal surface 48 and the trailing surface 50 after the tape is applied thereto Frame 40 includes parallel frame side plates 60 and 62 secured together by transverse posts 64, 66, 68 and 70.

Application member 42 includes parallel spaced side plates 72 and 74 secured together by posts 76, 78, 80. The application member has a width that is less than the spacing between frame side plates 60 and 62. The application member 42 which includes application roller 82 rotatively supported on side plates 72 and 74 of the application member 42. The application roller 82 provides an arcuate periphery for the application of tape to a box, as will be discussed hereinafter. However, it is recognized that a non-rotating member having an arcuate periphery may be mounted on the application member in place of the application roller 82, if desired.

The means adapted for defining a tape route includes a hub 84 mounted on frame 40 (or any other convenient structure), about which hub 84 a supply roll 86 of tape 16 may be releasably engaged. Idler roller 88 is rotatably mounted on frame side plate 60 and the tension roller 90 having a surface adapted for releasable frictional contact (such as by knurling the surface in contact with the tape) with the adhesive surface of tape, which tension roller 90 is rotatably mounted to frame side plate 60 via an adjustable friction clutch (not shown) to provide a desired tension in tape 16 along the tape path subsequent to the tension roller 90. Also included are a second knurled tension roller 92 for guiding the adhesive coated surface of tape and a second idler roller 94, both mounted on and between application member side plates 72 and 74. In the illustrated embodiment of the invention, frame side plate 60 is provided with slot 96, which enables the position of tension roller 90 to be adjusted relative to the tape path, and therefore to adjust the leading tape leg length of the tape 16 as it passes through the device 12.

Also provided is tape guide member 98 mounted between application member side plates 72 and 74 between rollers 92 and 94 and the application roller 82.

The tape guide member 98 includes tape supporting surface 100 for sliding engagement and support of the non-adhesive side of the tape 16 as it moves towards the application roller 82. A pair of tapered guide flanges 102 constrain lateral and orthogonal movement of the tape as the tape passes through the tape guide member 98. The tape 16 is thus guided from supply roll 86 around rollers 88, 90, 92, and 94, though tape guide member 98 to application roller 82.

In an alternate embodiment, the tape guide member 98 may include means to maintain the position of the tape relative to the tape applying device, particularly on the lower tape applying device 14 where gravity will tend to displace the tape. This problem is exasperated by the presence of high humidity or similar conditions. The means for maintaining the tape in position may include a finger projecting from tape guiding surface 100, although any other suitable arrangement may be employed. The finger ensures that the tape will not bind or stick to the tape guide member 98 as it passes therethrough.

The means for mounting the application member 42 on the frame 40 comprises parallel spaced guide members 110 and 112, each mounted on facing sides of the frame side plates 60 and 62. Each guide member 110 and 112 includes a track 114 and 116. Each track has a first track portion 114', 116' and a second track portion 114'', 116''. Two pair of wheels or rollers 118 and 120 are mounted in aligned positions on each of the application member side plates 72 and 74 to engage the tracks 114 and 116. In the illustrated embodiment, rollers 118 are rotatively connected to each end of post 76 and rollers 120 are rotatively connected to each end of post 78. Thus, the application member 42 may slide reciprocally between a first, or contact position shown in FIG. 8, and a second position at the opposite end of the tracks 114 and 116, shown in FIGS. 9 and 10, relative to the frame 40.

The means for severing an applied length of tape 16 from the supply length, after tape has been applied to a box 18 moving along a predetermined path in direction 44 in the machine 10 comprises a shoe 130. Shoe 130 includes parallel side plates 132 and 134 connected adjacent its front end by post 136 and adjacent the back end by post 138. The shoe side plates 132 and 134 are pivotally mounted on each side to frame side plates 60 and 62 at point 139. A pair of springs 142 are connected at one end to post 136 and at the other by post 64 connecting the frame side plates 60 and 62 together. The springs 142 bias the shoe 130 to a normal position with an edge surfaces 144 of the shoe 130 projecting into the path for the box through the machine 10, and a set position with the edge surface 144 of the shoe 130 resting against the longitudinal surface 48 of a box moving along the path. A pair of resilient bumpers 146 are mounted on the ends of the shoe side plates 132 and 134 adjacent post 136 and contact shoulders 148 of frame side plates 60, 62 to cushion any impact when the shoe rapidly returns to its normal position.

The shoe side plates 132 and 134 are spaced to reoeive tape 16 therebetween after the tape as been applied by the application roller 82 to a box moving past the tape applying device 12. Bracket 150 is mounted on either end to shoe side plates 132, 134. Knife 152 is mounted to bracket 150, such as by screws 154, between the side plates 132, 134 of the shoe 130. Post 156 is mounted on either end to shoe side plates 132, 134 adjacent knife 152, but opposite application roller 82. Knife guard 158 is pivotably mounted on post 156 along a side surface of the knife to afford movement of the knife guard 158 from a safety position adjacent a serrated tapered edge 160 of the knife 152 (to which safety position the guard 158 is biased by a spring, not shown, at its pivot point) and a position spaced from the edge 160 of the knife 152 (FIGS. 9 and 10) upon contact of a distal portion of the guard sized to extend past the surfaces 144 of the shoe 130 to engage the surface of a box moving along the path.

Figure 10:
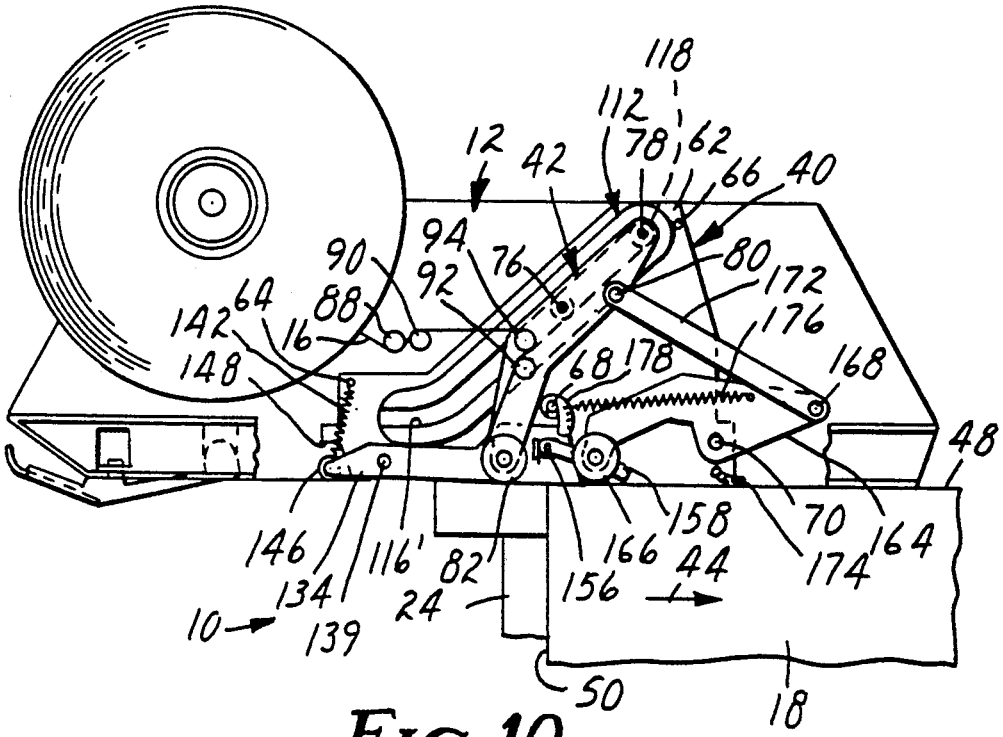
Figure 11:
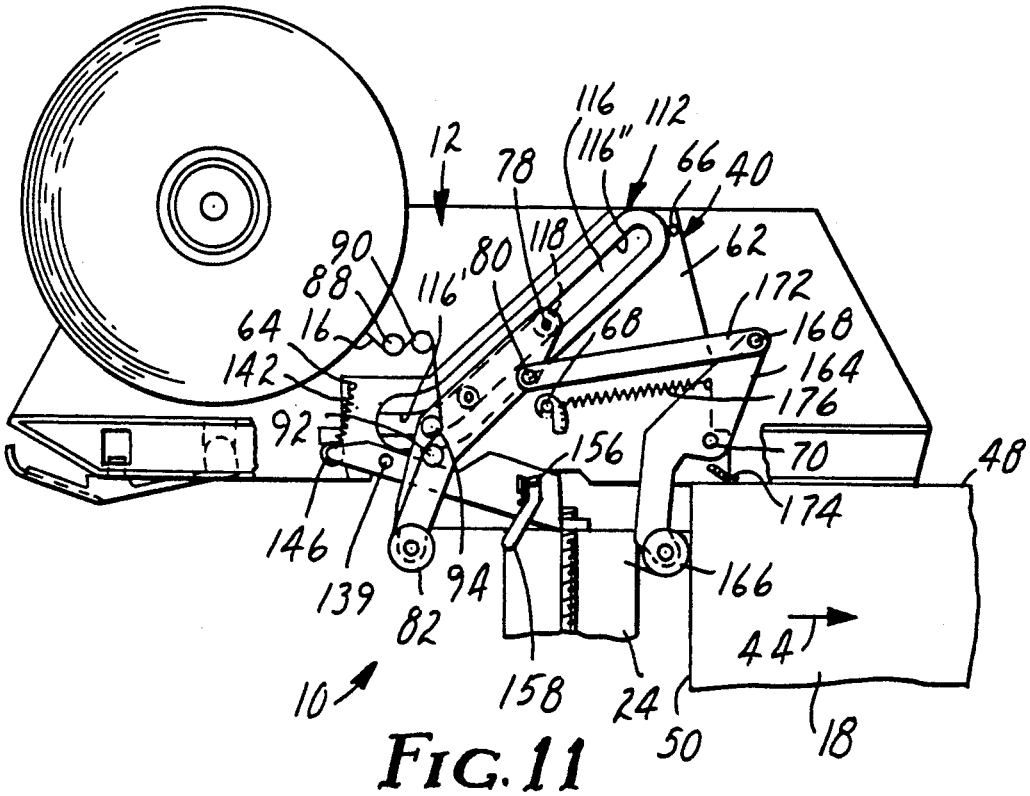

As is best seen in FIG. 10, the guard 158 also has sufficient length to extend beyond the distal end of the shoe 130 so that the guard 158 will remain in contact with a box moving along the path after the surface 144 of the shoe has lost contact therewith. As such contact is lost, the shoe 130 will return to its normal position under the influence of springs 142 while the guard 158 remains retracted from the edge 160 of the blade 152 via contact with the box so that the edge 160 of the blade 152 will engage and sever a length of tape 16 extending from the trailing surface 50 of the box 18 to the application roller 82 (FIG. 11). This will produce a length of tape extending from the trailing edge of the box which will be applied to the trailing surface 50 of the box by a buffing roller, as will later be explained.

Although not shown, the tape applying device of this invention may also include a strip of material mounted on knife guard 158 so as to come into contact with the knife 152 adjacent edge 160 when the knife guard assumes its safety position. The strip of material is absorbent and may be constructed of a felt like fabric to absorb an oil or lubricant. Thus, when the knife guard 158 rapidly returns to its safety position, the strip of material contacts or "wipes" edge 160 of the knife 152 each time the knife cuts through the tape 16. The coating of the knife edge 160 with the lubricant prevents or reduces build up of the pressure sensitive adhesive on the knife that might interfere with the operation of the knife.

The means for firmly buffing an applied length of tape against a box driven along the path includes a pair of laterally spaced buffing arms 162, 164 rotatably supporting buffing roller 166 at one end and connected at on opposite end by post 168. The buffing arms 162, 164 are pivotally mounted on post 70 connecting the frame side plates 60 and 62, intermediate post 168 and buffing roller 166. A pair of linkage arms 170 and 172 are pivotally connected at one end to post 168 and at the other end to post 80 connecting application member side pates 72 and 74, to connect buffing arms 162, 164 to the application member 42.

In its start position the buffing arms 162, 164 position the buffing roller 166 in the path of a box 18 moving past the device 12. After such contact (FIG. 9), the buffing arms 162, 164 will rotate to move with the box pressing buffing roller 166 into contact with the tape 16 applied on the longitudinal surface 48 of the box. The buffing roller 166 will then sequentially move along that surface and the trailing surface 50 of the box to press the applied tape 16 into firm engagement therewith. When the buffing roller 166 loses contact with the box and the application member 42 returns to its contact position, buffing roller 166 simultaneously returns to its start position.

In the illustrated embodiment, the means for buffing the tape also includes a brush or the like 174 mounted on post 175 of the frame above the buffing roller. Brush 174 assists in buffing the tape along the longitudinal surface 48 and the trailing surface 50 of the box 18.

Figure 8:
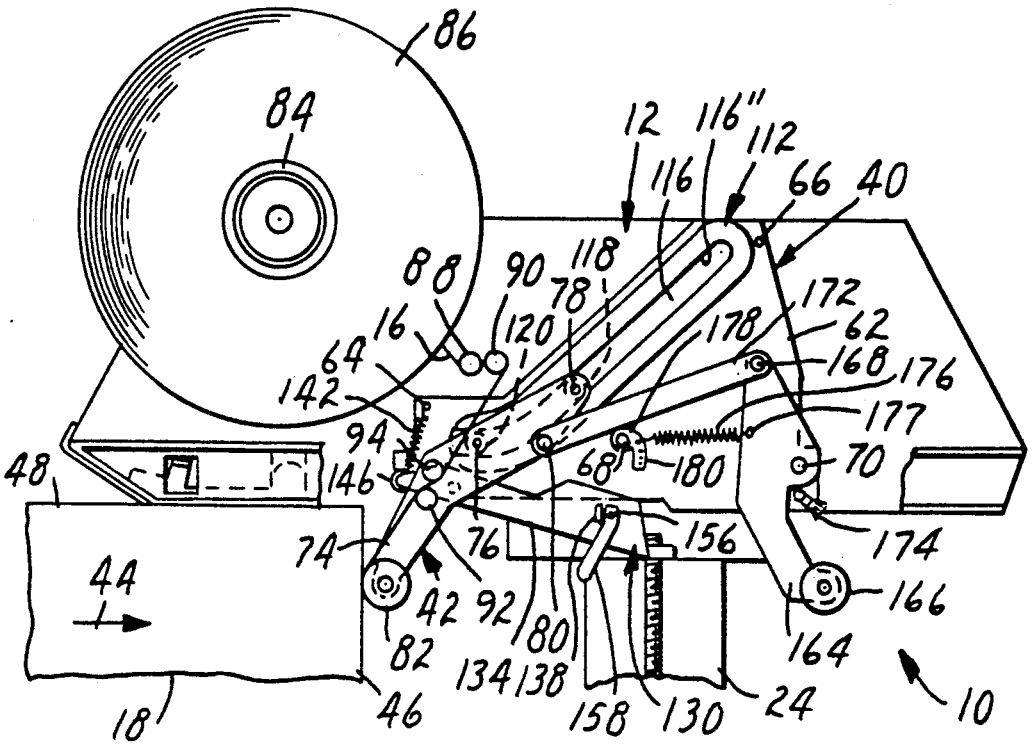
FIGS. 8, 9, 10, and 11 are enlarged fragmentary views sequentially illustrating the application of tape to a box by one of the devices incorporated in the machine shown in FIG. 1.

Means are provided to bias the application roller and the buffing roller to extended positions relative to frame 40. In the illustrated embodiment, the biasing means includes spring 176 connected at one end to post 177 mounted between buffing arms 162, 164 and at the other end to post 68 connecting application member side plates 72 and 74. The force of the spring 176 urges the application roller 82 and the buffing roller 166 to extended positions (as shown in FIG. 8) relative to the devices 12,14 when not in contact with a box.

Device 14 on machine 10 functions in the same manner as device 12 and has essentially the same parts which are identified with the same reference numerals used in the description of parts for device 12. The parts of device 14, however, are disposed in mirror image positions with respect to corresponding parts of device 12.

In regard to device 12, it may be possible in some situations to omit the spring 176 and to rely entirely on gravity to bias the application roller and the buffing rollers to extended positions. Similarly, it may be possible to provide a weaker spring 176 in regard to the device 12, as compared to the corresponding spring provided for device 14, and to supplement the force of the spring with gravity.

In either of the devices 12, 14, the buffing force may be adjusted by inclusion of bracket 178 connecting one end of spring 176 to post 68 by hook 180. Bracket 178 includes an arcuate array of holes 182 for connection to the spring 176. Depending on the hole 182 that the spring 176 is connected to, the spring may be prestretched to a predetermined degree, so that the resistance to further movement of the buffing roller can be selected.

Of course, other suitable buffing arrangements may be employed, such as is shown in the Deering, Jr. '269 patent, in which case, the buffing roller is not linked to the application member, in contrast to the illustrated embodiment.

The operation of device 12 in applying a length of tape will now be explained. Prior to movement of a box 18 past device 12, application roller 82 is in its contact position in the path for the box. An end portion of the supply length of tape 16 is positioned adjacent application roller 82 with the adhesive surface on tape facing the direction from which the box 18 will approach the device. Upon contact with the leading surface 46 of the box 18 driven along the path, the end portion of tape 16 will adhere to the leading surface. Subsequently, movement of the box 18 will first cause movement of the application roller 82 from its application position against means (previously described herein) for biasing the application roller 82 to its contact position, which will press a portion of tape 16 into engagement with the box 18. The application member will traverse the first path portion (as proscribed by first route portions 114' and 116') generally aligned with the movement of the box 18. This substantially reduces the force of the impact of the application roller 82 on the box, since less force is required to overcome the inertia of the application roller and bring it up to the speed of the box in direction 44.

Subsequently, the application member enters the second path portion when the rollers 118 enter the second route portions 114" and 116". The application member 42 then travels upwardly in a generally linear path (as herein defined) inclined with respect to the predetermined path of the box in direction 44 until the application roller 82 reaches its second position. For the purposes of this invention, the term "generally linear" includes not only straight lines, but also all uninterrupted paths that connect two defined points so that the motion of the application member derives the uniform force applied to a box as in the '269 patent in the second route portion of the present invention. Preferably, the second route portion is inclined at an angle in a range of between 35 degrees and 55 degrees with respect to the path of the carton, and most preferably, the second route portion is inclined at an angle of about 45°. Thus during the second route portion, the tape applying device of this invention is provided with all of the benefits described in the '269 patent of a low, uniform force as the tape is applied to the leading surface.

After application roller 82 reaches its second position, movement of the box 18 will pull the tape from roll 86 for application along longitudinal surface 48 of the box 18. Movement of application roller 82 from its contact to its second position is constrained by engagement of the tracks 114, 116 by the wheels 118, 120 so that the force is uniform as the application roller 82 travels transversely across the longitudinal surface 48 of the box 18.

Figure 7:
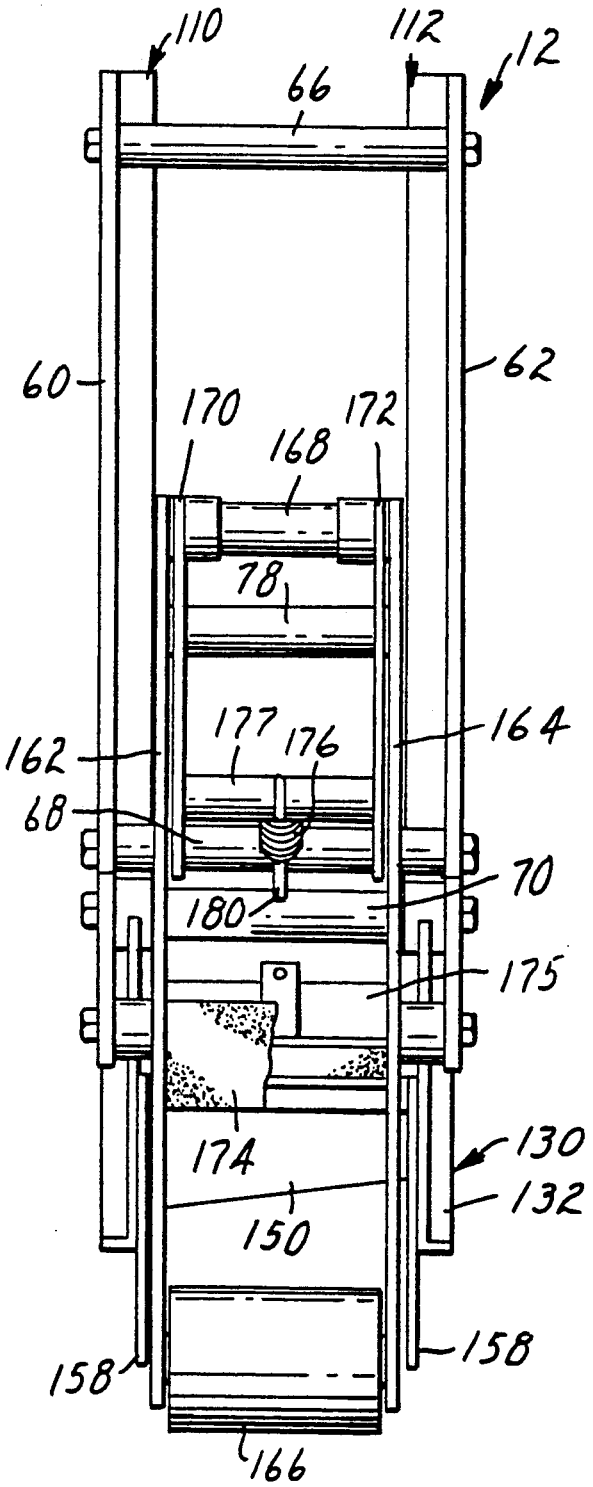
FIG. 7 is a back end view of the upper tape applying device of FIG. 3.
Figure 9:
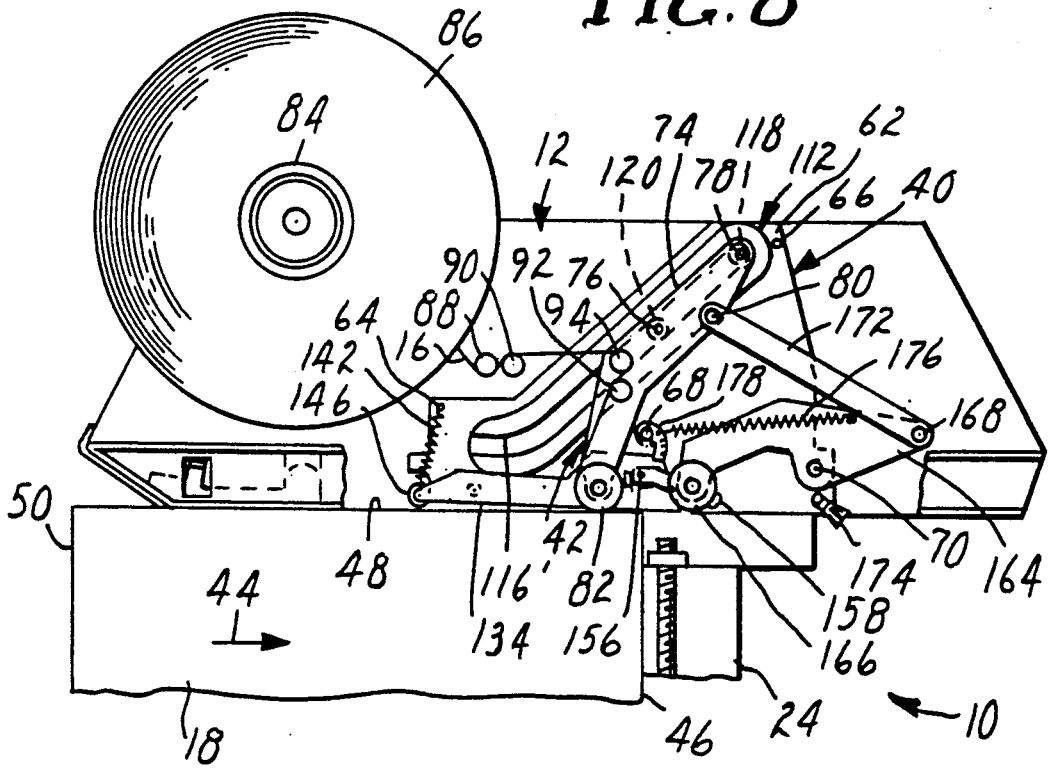

As box 18 moves application roller 82 from its contact to its second position, it will also engage edge surface 144 on shoe 130 to move it to its set position, and contact guard 158 for knife 152 to pivot guard 158 away from knife's edge 160 (FIGS. 9 and 10). After the trailing edge of box 18 subsequently moves past application roller 82 and the distal end of shoe 130, shoe 130 will return to its normal position causing knife 152 (the guard for which is still pivoted away from its edge by contact with box 18) to sever tape 16 then extending between application roller 82 and box 18 (FIG. 7).

During such movement the application roller 82 will advance along the longitudinal surface of the box until application roller 82 is adjacent the distal end of the box. Movement of the box along the path will also cause the box to engage buffing roller 166 which will buff the applied tape firmly against the surfaces 48 and 50 of box 18 in the manner described above. Subsequent to the severing of the tape by knife 152 and the buffing of the trailing end of tape 16 along trailing surface 50 of the box, application roller 82 will return to its contact position in preparation for another box simultaneously with the return of the buffing roller to its extended position.

Figure 12:
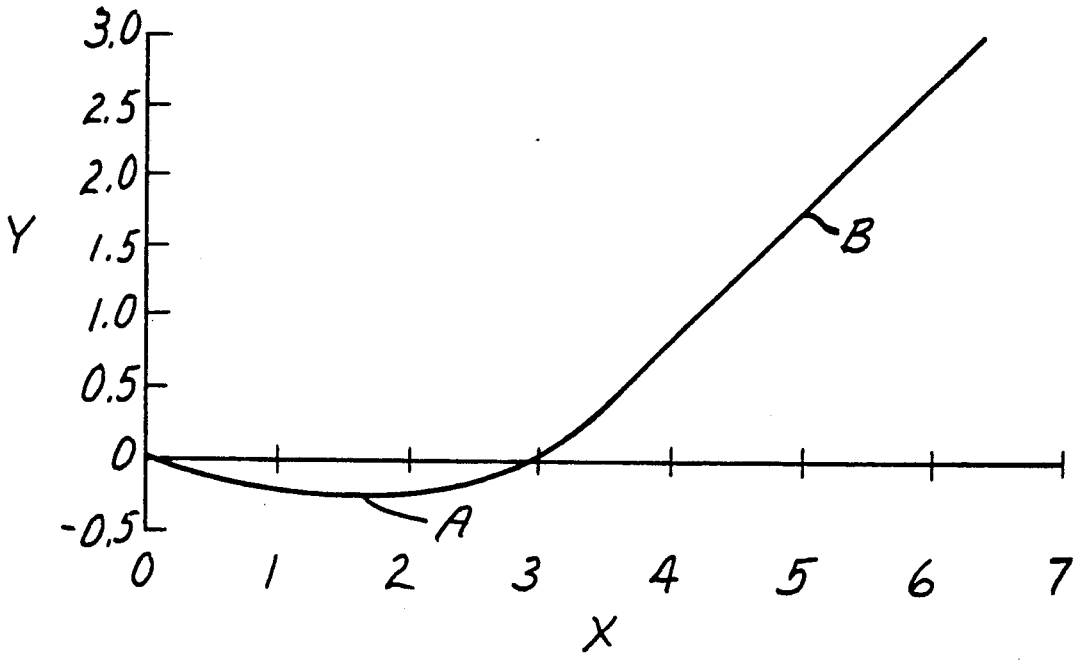
FIG. 12 is a graphical representation of the route of the application member between its contact position and its second position.

FIG. 12 illustrates the movement of the application roller 82 as the application member moves from the contact position to the second position. The first portion (A) of the route traveled by the application roller 82 is generally aligned with the direction of movement of the box along its predetermined path (which is represented by the X axis in FIG. 12). In the illustrated embodiment, the first route portion (A) is arcuate, but for the purposes of this invention is still generally in alignment with the first direction of movement of the box 18 along its predetermined path through machine 10. The second route portion (B) is generally linear and is inclined with respect to the first direction of the box.

With this arrangement, the impact force of the application member on a box is reduced during the first route portion of the application member 42. Since the movement of the application member 42 is generally in line with the movement of the box at the contact position and during the first route portion (A), the box does not have to overcome the force required to push the application member upwards along the second track portion (B) until the inertia of the application member has been overcome and the application member is traveling at essentially the same speed as the box in the first direction of travel of the box.

The reduction in the impact force provided by the tape applying device of the present invention is shown in the force measurements of Table 1. Column A represents the results of ten measurements utilizing an Accuglide TM brand tape applying device available from Minnesota Mining and Manufacturing Company of St. Paul, Minn., and constructed according to the '269 patent. Column B represents a tape applying device constructed according to the present invention. The Table displays the maximum impact force measured for ten runs through each device without tape. As is shown, the average maximum impact force is approximately 70% lower for the tape applying device constructed according to the present invention.

TABLE 1

| | A '269 PATENT MAX. INITIAL IMPACT FORCE | | B PRESENT INVENTION MAX. INITIAL IMPACT FORCE (Minimized) | | C PRESENT INVENTION MAX. INITIAL IMPACT FORCE (Optimized) | |
|---|---|---|---|---|---|---|
| RUN # | mv | lbs. | mv | lbs | mv | lbs. |
| 1 | 91.20 | 36.48 | 27.80 | 11.12 | 123.00 | 12.30 |
| 2 | 93.30 | 37.32 | 26.90 | 10.76 | 139.00 | 13.90 |
| 3 | 91.30 | 36.52 | 28.00 | 11.20 | 123.00 | 12.30 |
| 4 | 92.50 | 37.00 | 25.70 | 10.28 | 117.00 | 11.70 |
| 5 | 91.70 | 36.68 | 29.00 | 11.60 | 113.50 | 11.35 |
| 6 | 89.90 | 35.96 | 29.90 | 11.96 | 135.00 | 13.50 |
| 7 | 89.10 | 35.64 | 28.10 | 11.24 | 130.50 | 13.05 |
| 8 | 91.70 | 36.68 | 25.10 | 10.04 | 133.00 | 13.30 |
| 9 | 92.00 | 36.96 | 27.10 | 10.84 | — | — |
| 10 | 88.80 | 35.52 | 29.10 | 11.64 | — | — |
| | AVERAGE | 36.48 | AVERAGE | 11.07 | AVERAGE | 12.68 |

Figure 13:
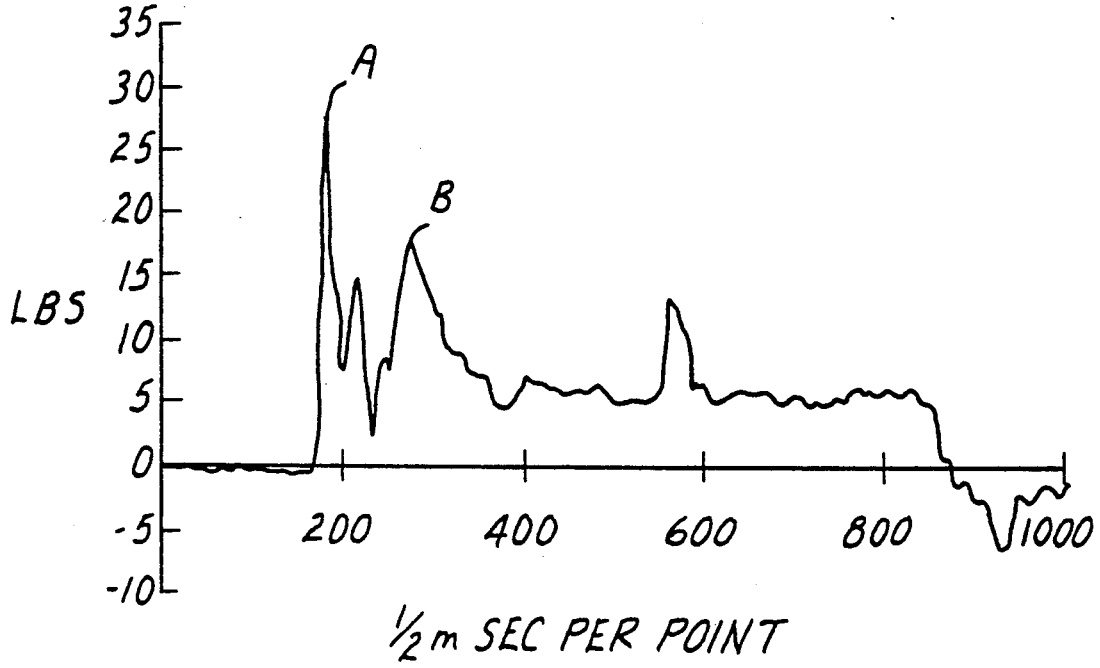
FIG. 13 is a graphical representation of the force applied by the application member of the '269 tape applying device on a box as the box moves past the device.
Figure 14:
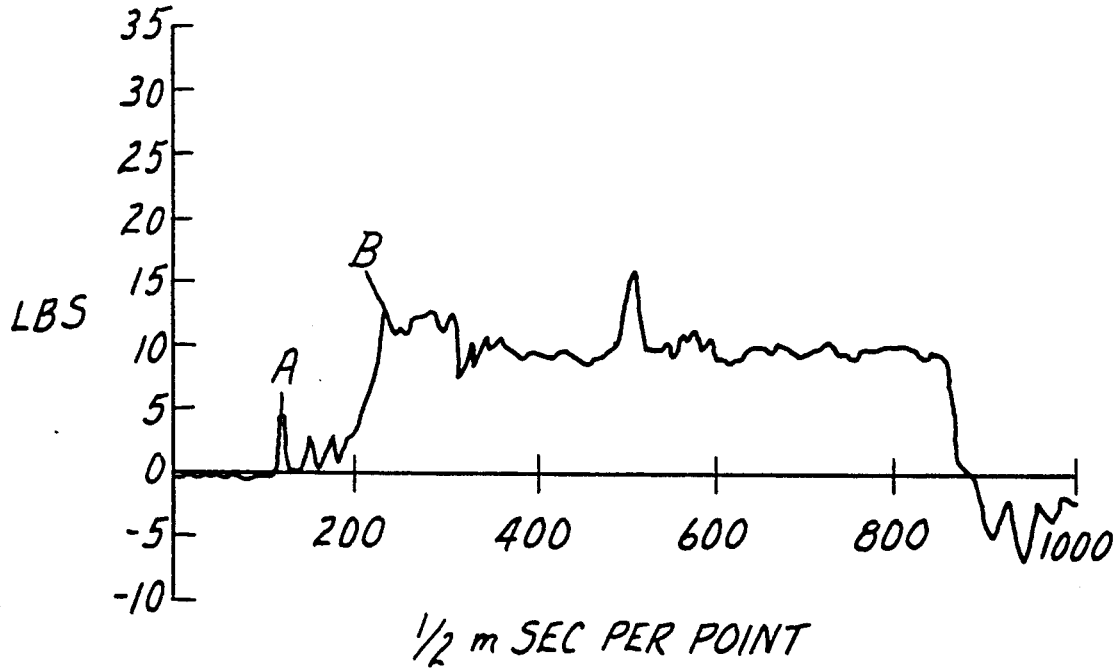
FIG. 14 is a graphical representation of the force applied by the application member of the tape applying device of this invention on a box as the box moves past the device.

The attenuation of the impact force of the tape applying device of the present invention is also illustrated in FIGS. 13 and 14. FIG. 13 graphically represents the measured force of impact of an Accuglide TM brand tape applying device available from Minnesota Mining and Manufacturing Company of St. Paul, Minn., and constructed according to the '269 patent. FIG. 14 is a corresponding graph for a tape applying device constructed according to the present invention. Point A in each graph is the maximum force of impact of the respective devices. Point B is the approximate edge of the box between the leading surface and the longitudinal surface and the force measured is the resistance encountered by the box due to spring tension and the knife guard. As is shown, the maximum impact force is dramatically attenuated by the construction of the present invention.

Further attenuation of the impact force of the tape applying device of this invention may be achieved by constructing the device in a manner that reduces the inertia of the device in moving from its contact position to its second position. For instance, use of lightweight materials such as aluminum in place of relatively heavy steel will tend to reduce the inertia, as well as designs that minimize the size, thickness and weight of components of the tape applying device in a manner known in the art.

Yet, another factor affecting the level of the impact force of the application member on the leading surface of the box is the configuration of the linkage between the application member and the buffing mechanism. The most efficient arrangement of the application member for minimizing the impact force is where the angle $\alpha$ (shown in FIG. 4) between the application side pates 72, 74 and the linkage arms 170, 174 is about 90° and the angle $\beta$ (also shown in FIG. 4) between the linkage arms 170, 172 and the buffing arms 162 and 164 is also 90°. The angle $\alpha$ is determined between a line extending through linkage arms 172 and 174 and a line, as shown, extending from the pivotal connection between the linkage arm and the application member 72 and 74, upwardly to the intersection between a first and second lines extending from the rotative axis of the wheels 118 and 120 perpendicular to the inclination of the tracks 114 and 116 when the application member is in its first or contact position. The angle $\beta$ is measured between the aforementioned line extending through the linkage arms 172 and 174 and a line extending through the pivotal linkages at 168 and 70 of the buffing arm 164.

This construction provides the most efficient mechanical advantage for contacting the leading surface of the box and accelerating the application member from its contact position. However, in such cases the buffing of the trailing leg of the tape may be inadequate. That is, the buffing arms can not keep up with the box and lose contact with the box resulting in a loop of tape not pressed against the box. It thus becomes desirable to optimize the angular arrangement between the application member and the buffing arms and roller to reduce the impact force of the application member to the lowest possible point and while ensuring effective buffing of the tape once it is applied to the box.

For the illustrated embodiment, angles a in the range of 70° to 90° in combination with angles b in the range of 90° to 160° have been found to be satisfactory, depending on the exact location, shape and size of the application member and the buffing mechanism. Most preferably, an angle $\alpha$ of 80° and an angle $\beta$ of 140° have been found to balance the lowest possible impact force with effective buffing of the trailing edge of the tape to the box. The results of tests conducted of a tape applying device according to the present invention and having an angle $\alpha$ of 80° and an angle $\beta$ of 140° is shown in Column C of Table 1. In contrast, the Accuglide TM brand tape applying device marketed by the Minnesota Mining and Manufacturing Company, corresponding to the '269 patent (shown in Column A of Table 1) includes an angle $\alpha$ of 110° and an angle $\beta$ of 65°. As is evident from this Table, the optimized arrangement wherein the angle a is in the range of 70° to 90° in combination with angles b in the range of 90° to 160°, and most specifically, an angle $\alpha$ of 80° and an angle $\beta$ of 140° slightly increases the impact force on a box relative to the $\alpha=90°$, $\beta=90°$ design, but still exhibits a substantial improvement over previous tape applying devices.

The present invention has now been described with reference to several embodiments thereof. It will be apparent to those skilled in the art that many changes can be made in the embodiments described without departing from the scope of the present invention. Thus, the scope of the present invention should not be limited to the structures described in this application, but only by structures described by the language of the claims and the equivalents of those structures.

What is claimed is:

1. A device for applying lengths of pressure sensitive adhesive coated tape from a supply length of tape seriatim on spaced rectangular objects driven along a predetermined path in a first direction past the device, said device comprising:

a frame;

an application member having an arcuate periphery;

means for defining a tape route for said supply length of tape to the arcuate periphery of said application member with the adhesive coating disposed away from said application member;

means for mounting said application member on said frame to afford movement thereof from a contact position with said tape route in the path of the rectangular object to afford contact between an end of the tape disposed along said tape route at said arcuate periphery of said application member and a leading surface of the rectangular object driven along the path in the first direction to adhere tape to the leading surface of the rectangular object, to a second position while pressing the tape against the leading surface of the rectangular object, at which second position said application member will press tape being applied against a longitudinal surface of the object, and back to said contact position, wherein said mounting means includes a guide member operatively connected with said frame for defining a first portion of movement of said application member for attenuating the impact force of the application member on the leading surface of the rectangular object and a second generally linear portion of movement of said application member; and means mounted on said frame and adapted to be activated by movement of the rectangular object past a predetermined position along the path for severing an applied length of tape from said supply length.

2. A device according to claim 1 wherein said means for mounting said application member comprises a pair of aligned laterally spaced guide members mounted on said frame, each of said guide members having a track, with said application member having a plurality of rollers engaging said tracks, said attenuating means including first track portions of said tracks for locating said application member at said contact position and adapted to provide movement of said application member along first portion of movement generally aligned with the first direction of movement of the object so as to attenuate the impact force of the application member on the leading surface of the rectangular object, and a second track portion adapted to provide generally linear movement of said application member to said second position along second portion of movement with a component of movement for the application member along said second portion being in the first direction of movement of the rectangular object.

3. A device according to claim 2 wherein said second portion of movement of said application member is disposed at an angle in the range of about 35 to 55 degrees with respect to the predetermined path for the rectangular objects.

4. A device according to claim 1, further including means for buffing the tape against the rectangular object.

5. A device according to claim 1, further including means for resiliently biasing said application member to said contact position.

6. A device for applying lengths of pressure sensitive adhesive coated tape from a supply length of tape seriatim on spaced rectangular objects driven along a predetermined path in a first direction past the device, said device comprising:

a frame having a pair of laterally spaced frame side plates secured together by a plurality of posts;

an application member having a pair of laterally spaced application side plates secured together by a plurality of posts, and including an application roller having an arcuate periphery, said application roller rotatively mounted on said application side plates;

means for defining a tape route for a said supply length of tape to the arcuate periphery of said application member with the adhesive coating disposed away from said application member;

means for mounting said application member on said frame comprising a pair of aligned laterally spaced guide members, each mounted on facing surfaces of one of a frame side plates, each of said guide members having a track, with said application member having a plurality of rollers engaging said tracks, with each of said tracks having first track portions for locating said application member at said contact position and adapted to provide movement of an application member along said first portion of movement generally aligned with the first direction of movement of the object to attenuate the impact force of the application member on the leading surface of the rectangular object, and a second track portion adapted to provide generally linear movement of said application member to said second position along said second portion of movement with a component of movement for the application member along said second portion being in the first direction of movement of the rectangular object;

means mounted on said frame and adapted to be activated by movement of the rectangular object past a predetermined position along the path for severing an applied length of tape from said supply length; and means for buffing the tape against the rectangular object.

7. A device according to claim 6 wherein said second portion of movement of said application member is disposed at an angle in the range of about 35 to 55 degrees with respect to the predetermined path for the rectangular objects.

8. A device according to claim 6, wherein said buffing means includes a buffing roller mounted on at least one buffing arm pivotally connected to said frame side plates.

9. A device according to claim 8, further including at least one linkage arm connected to said application member and to said at least one buffing arm adapted to extend or retract said buffing roller responsive to movement of said application member between said contact position and said second position as the rectangular object moves past the device.

10. A device according to claim 9, wherein the included angle between said application member and said at least one linkage arm is in the range of 70° to 90° and the included angle between said at least one linkage arm and said at least one buffing arm is in the range of 90° to 160°.

11. A device according to claim 10, wherein the included angle between said application member and said at least one linkage arm is 80° and the included angle between said at least one linkage arm and said at least one buffing arm is 140°.

12. A device according to claim 6, further including means for resiliently biasing said application member to said contact position.

* * * * *

UNITED STATES PATENT AND TRADEMARK OFFICE

CERTIFICATE OF CORRECTION

PATENT NO. : 5,228,943
DATED : July 20, 1993
INVENTOR(S) : Lloyd S. Vasilakes

It is certified that error appears in the above-indentified patent and that said Letters Patent is hereby corrected as shown below:

Col. 1, line 68, insert a period after "member".

Col. 5, line 60, "reoeive" should be --receive--.

Col. 11, line 63, insert --a-- before "first".

Col. 12, line 1, insert --a-- before "second".

Col. 12, line 42, "said" should be --a--.

Col. 12, line 49, "said" should be --a--.

UNITED STATES PATENT AND TRADEMARK OFFICE

CERTIFICATE OF CORRECTION

PATENT NO. : 5,228,943

DATED : July 20, 1993

INVENTOR(S) : Lloyd S. Vasilakes

It is certified that error appears in the above-indentified patent and that said Letters Patent is hereby corrected as shown below:

Col. 12, line 43, "said" should be --a--.

Col. 12, line 49, "said" should be --a--.

Signed and Sealed this

Twenty-fourth Day of December, 1996

*Attest:*

Bruce Lehman

BRUCE LEHMAN

*Attesting Officer*

*Commissioner of Patents and Trademarks*